US005536451A

United States Patent [19]

Masters et al.

[11] Patent Number: 5,536,451

[45] Date of Patent: Jul. 16, 1996

[54] LIQUID HARD SURFACE DETERGENT COMPOSITIONS CONTAINING SHORT CHAIN AMPHOCARBOXYLATE DETERGENT SURFACTANT

[75] Inventors: Ronald A. Masters, Loveland; Michael S. Maile, Maineville; Martha R. Macy-Ruhe, Hamilton, all of Ohio

[73] Assignee: The Procter & Gamble Company, Cincinnati, Ohio

[21] Appl. No.: 183,537

[22] Filed: Jan. 18, 1994

Related U.S. Application Data

[63] Continuation-in-part of Ser. No. 151,434, Nov. 12, 1993, abandoned, which is a continuation-in-part of Ser. No. 966,207, Oct. 26, 1992, abandoned.

[51] Int. Cl.[6] ..... C11D 1/88; C11D 1/90; C11D 1/92; C11D 3/43

[52] U.S. Cl. ..... 510/405; 510/427; 510/490; 510/494; 510/506; 510/499; 510/505; 510/182

[58] Field of Search ..... 252/545, 546, 252/153, 548, DIG. 7, DIG. 10

[56] References Cited

U.S. PATENT DOCUMENTS

| | | | |
|---|---|---|---|
| 2,528,378 | 10/1950 | Mannheimer et al. | 252/546 |
| 3,280,179 | 10/1966 | Ernst | 260/501 |
| 3,309,321 | 3/1967 | McMaster | 252/152 |
| 3,539,521 | 11/1970 | Snoddy et al. | 252/137 |
| 3,649,569 | 3/1972 | McCarty | 252/543 |
| 3,696,043 | 10/1972 | Labarge et al. | 252/153 |
| 3,755,559 | 8/1973 | Hewitt | 424/70 |
| 3,840,480 | 10/1974 | Barrat et al. | 252/545 |
| 3,842,847 | 10/1974 | Hewitt et al. | 132/7 |
| 3,849,548 | 11/1974 | Grand | 424/70 |
| 3,928,065 | 12/1975 | Savino | 134/7 |
| 3,928,251 | 12/1975 | Bolich, Jr. et al. | 252/545 |
| 3,935,130 | 1/1976 | Hirano et al. | 252/542 |
| 3,950,417 | 4/1976 | Verdicchio et al. | 252/545 |
| 3,962,418 | 6/1976 | Birkofer | 424/70 |

(List continued on next page.)

FOREIGN PATENT DOCUMENTS

| | | | |
|---|---|---|---|
| 88168 | 9/1982 | Australia | C11D 10/04 |
| 706409 | 3/1965 | Canada | 260/309.6 |
| 706408 | 3/1965 | Canada | 260/309.6 |
| 0004755 | 10/1979 | European Pat. Off. | C11D 1/94 |
| 0024031A1 | 2/1981 | European Pat. Off. | C11D 1/90 |
| 0040882A2 | 12/1981 | European Pat. Off. | C11D 3/16 |
| 0067635A2 | 12/1982 | European Pat. Off. | A61K 7/08 |
| 0106266A2 | 4/1984 | European Pat. Off. | C11D 3/43 |
| 0117135A2 | 8/1984 | European Pat. Off. | C11D 3/37 |
| 0157443 | 10/1985 | European Pat. Off. | C11D 1/83 |
| 0181212 | 5/1986 | European Pat. Off. | C11D 1/94 |
| 0205626A1 | 12/1986 | European Pat. Off. | C07C 143/14 |
| 0338850 | 10/1989 | European Pat. Off. | A61K 7/075 |
| 0373851A2 | 6/1990 | European Pat. Off. | C11D 1/94 |
| 0408174A1 | 1/1991 | European Pat. Off. | A61K 7/16 |
| 2336449 | 7/1973 | Germany | C11D 1/83 |
| 3610395 | 10/1987 | Germany | A61K 7/50 |
| 274332A3 | 12/1989 | Germany | C07C 143/15 |
| 275046A1 | 1/1990 | Germany | C07C 207/08 |
| 48-60706 | 8/1973 | Japan . | |
| 59-189197 | 10/1984 | Japan | C11D 1/94 |
| 60-141797 | 7/1985 | Japan | C11D 1/94 |
| 60-161498 | 8/1985 | Japan | C11D 1/94 |
| 60-195200 | 10/1985 | Japan | C11D 1/94 |
| 61-014296 | 1/1986 | Japan | C11D 3/14 |
| 61-014298 | 1/1986 | Japan | C11D 3/43 |
| 61-009500 | 1/1986 | Japan | C11D 1/88 |
| 62-257992 | 11/1987 | Japan | C11D 3/60 |
| 62-2252499 | 11/1987 | Japan | C11D 3/60 |
| 63-012333 | 1/1988 | Japan | B01F 17/16 |
| 1092298 | 4/1989 | Japan | C11D 1/88 |
| 1135898 | 5/1989 | Japan | A61K 7/7 |
| 1153796 | 6/1989 | Japan | A61K 7/7 |
| 1221496 | 9/1989 | Japan | C11D 1/2 |
| 1221497 | 9/1989 | Japan | C11D 1/62 |
| 2269200 | 2/1990 | Japan | C11D 1/94 |
| 2155996 | 6/1990 | Japan | C11D 10/04 |
| 2145697 | 6/1990 | Japan | C11D 1/92 |
| 2296899 | 12/1990 | Japan | A61K 7/7 |
| 3115495 | 5/1991 | Japan | C11D 1/10 |
| 3111494 | 5/1991 | Japan | C11D 1/94 |
| 3163052 | 7/1991 | Japan | C07C 233/47 |
| 3153797 | 7/1991 | Japan | C11D 1/88 |
| 3215410 | 9/1991 | Japan | A61K 7/7 |
| 3258900 | 11/1991 | Japan | A61K 7/7 |
| 84944 | 10/1984 | Romania | A61K 7/06 |
| 1544563 | 4/1979 | United Kingdom | C11D 1/94 |
| 2193505 | 2/1988 | United Kingdom | C11D 3/33 |
| WO91/09104 | 6/1991 | WIPO | C11D 7/32 |
| WO91/13610 | 9/1991 | WIPO | A61K 7/50 |
| WO91/15192 | 10/1991 | WIPO | A61K 7/50 |
| 9205234 | 4/1992 | WIPO . | |

OTHER PUBLICATIONS

N. Parris et al., "Soap Based Detergent Formulations. V. Amphoteric Lime Soap Dispersing Agents," JAOCS, 50(1973) pp. 509–512. No month available.

W. R. Noble et al., "Soap–Based Detergent Formulations: X. Nature of Detergent Deposits," JAOCS, 52(1975) pp. 1–4. No month available.

N. Parris et al., "Soap–Based Detergent Formulations: XII. Alternate Syntheses of Surface Active Sulfobetaines," JAOCS, 53(1976) pp. 60–63. No month available.

F. D. Smith et al., "Soap–Based Detergent Formulations: XV. Amino Esters of alpha–Sulfo Fatty Acids," JAOCS, 53(1976) pp. 69–72. No month available.

Parris et al., "Soap–Based Detergent Formulations: XVIII.

(List continued on next page.)

*Primary Examiner*—Erin M. Harriman
*Attorney, Agent, or Firm*—Robert B. Aylor

[57] ABSTRACT

Aqueous, liquid hard surface detergent compositions having good filming/streaking characteristics contain short chain amphocarboxylate detergent surfactant; hydrophobic, volatile cleaning solvent; and, optionally, zwitterionic detergent surfactant and/or monoethanolamine and/or other specific beta-aminoalkanols for improved filming/streaking and good cleaning. Preferred formulas do not contain large amounts of builders and/or other materials that contribute to bad spotting and filming and said formulas are suitable for general purpose cleaning including cleaning of glass.

21 Claims, No Drawings

U.S. PATENT DOCUMENTS

| | | | |
|---|---|---|---|
| 4,110,263 | 8/1978 | Lindemann et al. | 252/545 |
| 4,122,043 | 10/1978 | Kersnar et al. | 252/527 |
| 4,148,762 | 4/1979 | Koch et al. | 252/544 |
| 4,181,634 | 1/1980 | Kennedy et al. | 252/545 |
| 4,186,113 | 1/1980 | Vericchio et al. | 252/526 |
| 4,214,908 | 7/1980 | Deguchi et al. | 106/13 |
| 4,233,192 | 11/1980 | Lindemann et al. | 252/545 |
| 4,246,131 | 1/1981 | Lohr | 252/153 |
| 4,257,907 | 3/1981 | Lagguth et al. | 252/106 |
| 4,259,217 | 3/1981 | Murphy | 252/547 |
| 4,261,869 | 4/1981 | Bishop et al. | 252/542 |
| 4,265,782 | 5/1981 | Armstrong et al. | 252/174.19 |
| 4,299,739 | 11/1981 | Esposito et al. | 252/545 |
| 4,329,334 | 5/1982 | Su et al. | 424/70 |
| 4,372,869 | 2/1983 | Lindemann et al. | 252/174.16 |
| 4,396,525 | 8/1983 | Rubin et al. | 252/174 |
| 4,414,128 | 11/1983 | Goffinet | 252/111 |
| 4,420,484 | 12/1983 | Gorman et al. | 424/326 |
| 4,438,096 | 3/1984 | Preston | 424/70 |
| 4,443,362 | 4/1984 | Guth et al. | 252/545 |
| 4,450,091 | 5/1984 | Schmolka | 252/174.21 |
| 4,452,732 | 6/1984 | Bolich, Jr. | 252/547 |
| 4,477,365 | 10/1984 | Verboom et al. | 252/156 |
| 4,485,029 | 11/1984 | Kato et al. | 252/106 |
| 4,529,588 | 7/1985 | Smith et al. | 424/70 |
| 4,554,098 | 11/1985 | Klisch et al. | 252/547 |
| 4,654,207 | 3/1987 | Preston | 424/70 |
| 4,673,523 | 6/1987 | Smith et al. | 252/91 |
| 4,683,008 | 7/1987 | Betts | 134/27 |
| 4,692,277 | 9/1987 | Siklosi | 252/558 |
| 4,698,181 | 10/1987 | Lewis | 252/527 |
| 4,769,169 | 9/1988 | Fishlock-Lomax | 252/106 |
| 4,769,172 | 9/1988 | Siklosi | 252/153 |
| 4,772,424 | 9/1988 | Greeb | 252/546 |
| 4,784,786 | 11/1988 | Smith et al. | 252/91 |
| 4,810,421 | 3/1989 | Marchesini | 252/546 |
| 4,876,034 | 10/1989 | Hirot et al. | 252/546 |
| 4,913,841 | 4/1990 | Zeman | 252/352 |
| 4,921,629 | 5/1990 | Malihi et al. | 252/170 |
| 4,948,531 | 8/1990 | Fuggini et al. | 252/544 |
| 5,015,412 | 5/1991 | Zeman | 252/311 |
| 5,061,393 | 10/1991 | Linares et al. | 252/143 |
| 5,108,660 | 4/1992 | Michael | 252/545 |

OTHER PUBLICATIONS

Effect of Structure Variations on Surface–Active Properties of Sulfur Containing Amphoteric Surfactants", JAOCS, 53(1976) pp. 97–100. No month available.

J. K. Weil et al., "Soap–Based Detergent Formulations: XX. The Physical and Chemical Nature of Lime Soap Dispersions," JAOCS, 53(1976) pp. 757–761. No month available.

J. K. Weil et al., "The Mutual Solubilization of Soap and Lime Soap Dispersing Agents," JAOCS, 54(1977) pp. 1–3. No month available.

T. J. Micich et al., "Soap–Based Detergent Formulations: XIX. Amphoteric Alkyl–succinamide Derivatives as Lime Soap Dispersants," JAOCS, 54(1977) pp. 91–94. No month available.

T. J. Micich et al., "Soap–Based Detergent Formulations: XXII. Sulfobetaine Derivatives of N–Alkylglutaramides and Adipamides," JAOCS, 54(1977) pp. 264–266. No month available.

N. Parris et al., "Soap Based Detergent Formulation: XXIV. Sulfobetaine Derivatives of Fatty Amides," JAOCS, 54(1977), pp. 294–296. No month available.

J. K. Weil et al., "Surface Active Properties of Combinations of Soap and Lime Soap Dispersing Agents," JAOCS, 54(1976) pp. 339–342. No month available.

J. M. Kaminski et al., "Soap–Based Detergent Formulations: XXIII. Synthesis of p–Sulfobenzyl Ammonium Inner Salts and Structural Correlation with Analogous Amphoterics," JAOCS, 54(1977) pp. 516–520. No month available.

F. D. Smith et al., "Soap–based Detergent Formulations: XXI. Amphoteric Derivatives of Fatty Amides of Aminoethylethanolamine," JAOCS, 55(1978) no month available pp. 741–744.

J. M. Kaminski et al., "Soap–Based Detergent Formulations: XXV. Synthesis and Surface Active Properties of Higher Molecular Weight Betaine Lime Soap Dispersants," JAOCS, 56(1979) pp. 771–774. No month available.

W. M. Linfield, "Soap and Lime Soap Dispersants," JAOCS, 55(1978), pp. 87–92. No month available.

W. R. Noble et al., "Soap–based Detergent Formulations: XXVI. Hard Water Detergency of Soap–lime Dispersant Combinations with Builders and Inorganic Salts," JAOCS, 57(1980), pp. 368–372. No month available.

J. G. Weers et al., "Effect of the intramolecular charge separation distance on the solution properties of betaines and sulfobetaines," Langmuir, 1991, no month available vol. 7(5), pp. 854–867. (Abstract only).

T. Takeda et al., "Synthesis and properties of a,w–bis(amidopropylhydroxy–sulfobetaine)–type amphoteric surfactants," Yukagaku, 1990, vol. 39(8), pp. 576–579. (Abstract only) no month available.

Chem. Abstract 102(22): 190818t—P. Busch et al., "Hair–conditioning effect of guar hydroxypropyl–trimethylammonium chloride. Part I.", Parfuem. Kosmet. 1984 no month available 65(11), 692, 694–6, 698.

Chem. Abstract 102(22):190819u—P. Busch et al., "Hair–conditioning effect of guar hydroxypropyl–trimethylammonium chloride. Part 2.", Parfuem. Kosmet. 1984 no month available 65(12), 756, 758–60.

Chem. Abstract 108(1):5366g—C. A. Bunton, "Micellar effects on nucleophilicity," Adv. Chem. Ser. 1987, 215(Nucleophilicity), 425–41. No month available.

Chem. Abstract 115(6):56929v—CTFA, Inc., "Final report on the safety assessment of cocamidopropyl betaine," J. Am. Coll. Toxicol. 1991, 10(1). 33–52. No month available.

Chem. Abstract 115(14):138653g—V. Allikmaa, "Highly efficient reversed–phase HPLC studies of amphoteric and cationic amido group–containing surfactants," Eesti Tead. Akad. Toim., Keem 1991, 40(1), 67–72. No month available.

Soap Based Detergent Formulations: XII. Alternate Syntheses of Surface Active Sulfobetaines, Parris et al., J. Amer. Oil Chem. Soc., vol. 53, Feb. 1976, no month available pp. 60–63.

Zwitterionic Surfactants: Structure and Performance, Fernly, Journal of The Oil Chemists' Society, vol. 55, Jan. 1978, pp. 98–103 no month available.

Chem. Abs. 77(12):77046s—A. Koeber et al., REWO; "Ampholytic cycloimidinium surfactants," Soap, Cosmet., Chem. Spec., 48(5), 86, 88, 193. 1972 no month available.

Chem. Abs. 78(2):5704c—A. Koebner et al., REWO; "Ampholytes," Ger. Offen. 10 pp., DE 2063423, published Sep. 21, 1972.

Chem. Abs. 81(11):63632a—Rewo Chemische Fabrik, "Amphoteric quaternary imidazolines useful as surface–active agents," Brit. 8 pp., GB 1,352,770, May 8, 1974.

Chem. Abs. 90(8):56735u—Hein et al., REWO, "Contribution to the structure of amphoteric surfactant," Fette–Seifen–Anstrichm., 80(11), 448–53. 1978 no month available.
Chem. Abs. 103(24):197694d—Hein, REWO; "Surface active derivatives of ricinoleic acid," Fette–Seifen–Anstrichm., 87(7), 283–8. 1985 no month available.
Chem. Abs. 105(20):174830x—Hein, REWO, "Effect of amphoteric surfactants in light–duty detergents," Comun. Jorn. Com. Esp. Deterg., 16, 91–100. 1985 no month available.
Chem. Abs. 107(8):64650x—Zabotto et al., Oreal S. A.; "Cosmetic cleansing composition, particularly eye makeup remover," Euro. Pat. Appl., 24 pp., EP 200620 A1, Dec. 10, 1986.
Chem. Abs. 113(21):188305g—Schmidt et al., Z. Naturforsch., C: Biosci., 45(6) 729–32, "Short–wavelength absorbing complexes of chlorophyll a in micellar solution of cationic detergents." 1990 no month available.
Chem. Abs. 116(14):131640v—A. Domsch, REWO; "Amphoteric surfactants in detergents and cleaning products," Comun. Jorn. Com. Esp. Deterg., 22, 223–41. 1991 no month available.
Brochure: "Soap Scum Removal Using Varion® AM–V," Robert Pifer and James Denison, Sherex Chemical Co., Inc., Form. No. 10/91, 1991.

LIQUID HARD SURFACE DETERGENT COMPOSITIONS CONTAINING SHORT CHAIN AMPHOCARBOXYLATE DETERGENT SURFACTANT

CROSS-REFERENCE TO RELATED APPLICATION

This is a continuation-in-part of the copending U.S. patent application Ser. No. 08/151,434, filed Nov. 12, 1993, now abandoned of Ronald A. Masters and Michael S. Maile, which is a continuation-in-part of their U.S. patent application Ser. No. 07/966,207, filed Oct. 26, 1992, now abandoned, having the same title.

FIELD OF THE INVENTION

This invention pertains to liquid detergent compositions for use in cleaning hard surfaces. Such compositions typically contain detergent surfactants, solvents, builders, etc.

BACKGROUND OF THE INVENTION

The use of solvents and organic water-soluble synthetic detergents at low levels for cleaning glass are known.

General purpose household cleaning compositions for hard surfaces such as metal, glass, ceramic, plastic and linoleum surfaces, are commercially available in both powdered and liquid form. Liquid detergent compositions are disclosed in Australian Pat. Application 82/88168, filed Sep. 9, 1982, by The Procter & Gamble Company; U.K. Pat. Application GB 2,166,153A, filed Oct. 24, 1985, by The Procter & Gamble Company; and U.K. Pat. Application GB 2,160,887A, filed Jun. 19, 1985, by Bristol-Myers Company, all of said published applications being incorporated herein by reference. These liquid detergent compositions comprise certain organic solvents, surfactant, and optional builder and/or abrasive.

Liquid cleaning compositions have the great advantage that they can be applied to hard surfaces in neat or concentrated form so that a relatively high level of surfactant material and organic solvent is delivered directly to the soil. Therefore, liquid cleaning compositions have the potential to provide superior soap scum, grease, and oily soil removal over dilute wash solutions prepared from powdered cleaning compositions.

Nevertheless, liquid cleaning compositions, and especially compositions prepared for cleaning glass, need good filming/streaking properties. In addition, they can suffer problems of product form, in particular, inhomogeneity, lack of clarity, or excessive "solvent" odor for consumer use.

An object of the present invention is to provide detergent compositions which provide good general, including glass, cleaning without excessive filming and/or streaking.

SUMMARY OF THE INVENTION

The present invention relates to an aqueous, liquid, hard surface detergent composition having good filming/streaking characteristics comprising: (a) specific "short chain," especially acyl, amphocarboxylate detergent surfactant, as disclosed herein, having a hydrophobic group containing from about 6 to about 10 carbon atoms; (b) hydrophobic, volatile, cleaning solvent; (c) optionally, but desirably, zwitterionic detergent surfactant, containing a cationic group, preferably a quaternary ammonium group, and an anionic group, preferably a carboxylate, sulfonate, or sulfate group, more preferably a sulfonate group; (d) optionally, but desirably, either monoethanolamine, beta-aminoalkanol which contains from about three to about six carbon atoms, or mixtures thereof, preferably monoethanolamine; (e) optionally, a detergent builder; and the balance being (f) aqueous solvent system and, optionally, minor ingredients. The composition preferably does not contain amounts of materials, like conventional detergent builders, etc., that deposit on the surface being cleaned and cause unacceptable filming/streaking. The compositions can be formulated at usage concentrations, or as concentrates, and can be packaged in a container having means for creating a spray to make application to hard surfaces more convenient.

All percentages, parts, and ratios herein are "by weight" unless otherwise stated.

DETAILED DESCRIPTION OF THE INVENTION

In accordance with the present invention, it has been found that superior aqueous liquid detergent compositions for cleaning shiny surfaces such as glass contain $C_{6-10}$ "amphocarboxylate" detergent surfactant, typically at a pH of at least about 9.5, preferably at least about 10; a hydrophobic, volatile, cleaning solvent; and, optionally, other detergent surfactant with good filming/streaking characteristics like zwitterionic detergent surfactant, and, also optionally, monoethanolamine and/or certain beta-aminoalkanol compounds, and/or volatile hydrophobic solvent.

The Amphocarboxylate Detergent Surfactant

The aqueous, liquid hard surface detergent compositions (cleaners) herein contain from about 0.001% to about 1%, preferably from about 0.01% to about 0.5%, more preferably from about 0.02% to about 0.2%, and even more preferably from about 0.03% to about 0.10%, of $C_{6-10}$ short chain amphocarboxylate detergent surfactant. It has been found that these amphocarboxylate, and, especially glycinate, detergent surfactants provide good cleaning with superior filming/streaking for detergent compositions that are used to clean both glass and/or relatively hard-to-remove soils. Despite the short chain, the detergency is good and the short chains provide improved filming/streaking, even as compared to the optional, but preferred, zwitterionic detergent cosurfactants described hereinafter. Depending upon the level of cleaning desired and/or the amount of hydrophobic material in the composition that needs to be solubilized, one can either use only the amphocarboxylate detergent surfactant, or can combine it with cosurfactant, preferably said zwitterionic cosurfactants.

The "amphocarboxylate" detergent surfactants herein preferably have the generic formula:

$$RN(R^1)(CH_2)_nN(R^2)(CH_2)_pC(O)OM$$

wherein R is a $C_{6-10}$ hydrophobic moiety, typically a fatty acyl moiety containing from about 6 to about 10 carbon atoms which, in combination with the nitrogen atom forms an amido group, $R^1$ is hydrogen (preferably) or a $C_{1-2}$ alkyl group, $R^2$ is a $C_{1-3}$ alkyl or, substituted $C_{1-3}$ alkyl, e.g., hydroxy substituted or carboxy methoxy substituted, preferably, hydroxy ethyl or carboxymethoxy ethyl, each n is an integer from 1 to 3, each p is an integer from 1 to 2, preferably 1, and each M is a water-soluble cation, typically an alkali metal, ammonium, and/or alkanolammonium cation. These "amphocarboxylate detergent surfactants can be present in the composition of this invention at a level of from about 0.01% to about 15%. Such detergent surfactants are available, for example, from Sherex under the trade name Rewoteric AM-V, having the formula:

$$C_7C(O)NH(CH_2)_2N(CH_2CH_2OH)CH_2C(O)O^{(-)}Na^{(+)};$$

from Mona Industries, under the trade name Monateric 1000, having the formula:

$$C_7C(O)NH(CH_2)_2N(CH_2CH_2OH)CH_2CH_2C(O)O^{(-)}Na^{(+)};$$

and from Lonza under the name Amphoterge KJ-2, having the formula:

$$C_{7,9}C(O)NH(CH_2)_2N(CH_2CH_2OCH_2C(O)O^{(-)})CH_2C(O)O^{(-)}\ 2Na^{(+)}.$$

The Optional Zwitterionic Detergent Surfactant

Suitable optional zwitterionic detergent surfactants contain a cationic group, preferably a quaternary ammonium group, and an anionic group, preferably carboxylate, sulfate and/or sulfonate group, more preferably sulfonate. Successively more preferred ratios of amphocarboxylate detergent surfactant to zwitterionic detergent cosurfactant are from about 10:1 to about 1:10; preferably from about 3:1 to about 1:3, more preferably about 1:1.

Zwitterionic detergent surfactants, as mentioned hereinbefore, contain both a cationic group and an anionic group and are in substantial electrical neutrality where the number of anionic charges and cationic charges on the detergent surfactant molecule are substantially the same. Zwitterionic detergents, which typically contain both a quaternary ammonium group and an anionic group selected from sulfonate and carboxylate groups are desirable since they maintain their amphoteric character over most of the pH range of interest for cleaning hard surfaces. The sulfonate group is the preferred anionic group.

Preferred zwitterionic detergent surfactants have the generic formula:

$$R^313\ [C(O)—N(R^4)—(CR^5{}_2)_n]_mN(R^6)_2{}^{(+)}—(CR^5{}_2)_p—Y^{(-)}$$

wherein each y is preferably a carboxylate ($COO^-$) or sulfonate ($SO_3^-$) group, preferably sulfonate; wherein each $R^3$ is a hydrocarbon, e.g., an alkyl, or alkylene, group containing from about 8 to about 20, preferably from about 10 to about 18, more preferably from about 12 to about 16 carbon atoms; wherein each ($R^4$) is either hydrogen, or a short chain alkyl, or substituted (e.g., hydroxy) alkyl, containing from one to about four carbon atoms, preferably groups selected from the group consisting of methyl, ethyl, propyl, hydroxy substituted ethyl or propyl and mixtures thereof, preferably methyl; wherein each ($R^5$) is selected from the group consisting of hydrogen and hydroxy groups; wherein ($R^6$) is like $R^4$ except preferably not hydrogen; wherein m is 0 or 1; and wherein each n and p are a number from 1 to about 4, preferably from 2 to about 3, more preferably about 3; there being no more than about one hydroxy group in any ($CR^5{}_2$) moiety. The $R^3$ groups can be branched and/or unsaturated, and such structures can provide filming/streaking benefits, even when used as part of a mixture with straight chain alkyl $R^3$ groups. The $R^4$ groups can also be connected to form ring structures. Preferred hydrocarbyl amidoalkylene sulfobetaine (HASB) detergent surfactants wherein m=1 and y is a sulfonate group provide superior grease soil removal and/or filming/streaking and/or "antifogging" and/or perfume solubilization properties. Such hydrocarbylamidoalkylene betaines and, especially, hydrocarbylamidoalkylene sulfobetaines are excellent for use in hard surface cleaning detergent compositions, especially those formulated for use on both glass and hard-to-remove soils. They are even better when used with monoethanolamine and/or specific beta-aminoalkanol as disclosed herein.

A more preferred detergent surfactant, $C_{10-14}$ acylamidopropylene(hydroxypropylene)sulfobetaine, is available from the Sherex Company as a 40% active product under the trade name "Rewoteric CAS Sulfobetaine."

The level of optional zwitterionic detergent cosurfactant, e.g., HASB, in the composition is typically from about 0.001% to about 0.5%, preferably from about 0.02% to about 0.2%, more preferably from about 0.02% to about 0.15%, and even more preferably from about 0.03% to about 0.10%. The level in the composition is dependent on the level of amphocarboxylate detergent surfactant; the eventual level of dilution to make the wash solution, etc.

It is an advantage of the short chain amphocarboxylate and zwitterionic detergent surfactants, that compositions containing them can be more readily diluted by consumers since they do not interact with hardness cations as readily as conventional anionic detergent cosurfactants. These detergent surfactants are also extremely effective at very low levels, e.g., below about 1%.

Other zwitterionic detergent surfactants are set forth at Col. 4 of U.S. Pat. No. 4,287,080, Siklosi, incorporated herein by reference. Another detailed listing of suitable zwitterionic detergent surfactants for the detergent compositions herein can be found in U.S. Pat. No. 4,557,853, Collins, issued Dec. 10, 1985, incorporated by reference herein. Commercial sources of such surfactants can be found in McCutcheon's EMULSIFIERS AND DETERGENTS, North American Edition, 1984, McCutcheon Division, MC Publishing Company, also incorporated herein by reference.

The above patents and reference also disclose other detergent surfactants, e.g., anionic, and nonionic detergent surfactants, that can also be used in small amounts in the composition of this invention as cosurfactants. Typical of these are the alkyl- and alkylethoxylate- (polyethoxylate) sulfates, paraffin sulfonates, olefin sulfonates, alkoxylated (especially ethoxylated) alcohols and alkyl phenols, alpha-sulfonates of fatty acids and of fatty acid esters, and the like, which are well-known from the detergency art. When the pH is above about 9.5, detergent surfactants, like the amphocarboxylate, that are amphoteric at a lower pH are desirable detergent cosurfactants. For example, detergent surfactants which are $C_{12-18}$ acylamido alkylene amino alkylene sulfonates, e.g., compounds having the formula:

$$R—C(O)—NH—(C_2H_4)—N(C_2H_4OH)CH_2CH(OH)CH_2SO_3M$$

wherein R is an alkyl group containing from about 9 to about 18 carbon atoms and M is a compatible cation are desirable cosurfactants. These detergent surfactants are available as Miranol CS, OS, JS, etc. The CTFA adopted name for such surfactants is cocoamphohydroxypropyl sulfonate. It is preferred that the compositions be substantially free of alkyl naphthalene sulfonates.

In general, optional detergent surfactants useful herein contain a hydrophobic group, typically containing an alkyl group in the $C_{8-C18}$ range, and, optionally, one or more linking groups such as ether or amido, preferably amido groups. The anionic detergent surfactants can be used in the form of their sodium, potassium or alkanolammonium, e.g., triethanolammonium salts; the nonionics generally contain from about 5 to about 17 ethylene oxide groups. $C_{12}$–$C_{18}$ paraffin-sulfonates and alkyl sulfates, and the ethoxylated alcohols and alkyl phenols are especially preferred in the compositions of the present type.

Some suitable surfactants for use in such cleaners are one or more of the following: sodium linear $C_{8-18}$ alkyl benzene sulfonate (LAS), particularly $C_{11-12}$ LAS; the sodium salt of a coconut alkyl ether sulfate containing 3 moles of ethylene oxide; the adduct of a random secondary alcohol having a range of alkyl chain lengths of from 11 to 15 carbon atoms and an average of 2 to 10 ethylene oxide moieties, several commercially available examples of which are Tergitol 15-S-3, Tergitol 15-S-5, Tergitol 15-S-7, and Tergitol 15-S9, all available from Union Carbide Corporation; the sodium and potassium salts of coconut fatty acids (coconut soaps); the condensation product of a straight-chain primary alcohol containing from about 8 carbons to about 16 carbon atoms and having an average carbon chain length of from about 10 to about 12 carbon atoms with from about 4 to about 8 moles of ethylene oxide per mole of alcohol; a fatty acid amide, especially one having the preferred formula:

$$R^1-\overset{\overset{\displaystyle O}{\|}}{C}-N(R^2)_2$$

wherein $R^1$ is a straight-chain alkyl group containing from about 7 to about 15 carbon atoms and having an average carbon chain length of from about 9 to about 13 carbon atoms and wherein each $R^2$ is a hydroxy alkyl group containing from 1 to about 3 carbon atoms; a zwitterionic surfactant having one of the preferred formulas set forth hereinafter. The fluorocarbon surfactants, examples of which are FC-129, a potassium fluorinated alkylcarboxylate, and FC-170-C, a mixture of fluorinated alkyl polyoxyethylene ethanols, both available from 3M Corporation, as well as the Zonyl fluorosurfactants, available from DuPont Corporation, can be used in small amounts. It is understood that mixtures of various surfactants can be used.

For glass cleaning, the composition, when used full strength, or wash solution containing the composition, should contain from about 0.01% to about 1%, preferably from about 0.02% to about 0.5%, more preferably from about 0.05% to about 0.25%, of total detergent surfactant. For removal of difficult to remove soils like grease, the level can, and should be, higher, typically from about 0.1% to about 10%, preferably from about 0.15% to about 2%. Concentrated products will typically contain from about 0.2% to about 10%, preferably from about 0.3% to about 5%.

The Hydrophobic Volatile Cleaning Solvent

In order to obtain good cleaning without any appreciable amount of detergent builder, one can use a hydrophobic, volatile, cleaning solvent, i.e., one that has substantial cleaning activity, in addition to the detergent surfactant. The solvents employed in the hard surface cleaning compositions herein are selected from the well-known "degreasing" solvents commonly used in, for example, the dry cleaning industry, in the hard surface cleaner industry and the metalworking industry.

A useful definition of such solvents can be derived from the solubility parameters as set forth in "The Hoy," a publication of Union Carbide, incorporated herein by reference. The most useful parameter appears to be the hydrogen bonding parameter which is calculated by the formula:

$$\gamma H = \gamma T \left[ \frac{a-1}{a} \right]^{1/2}$$

wherein γH is the hydrogen bonding parameter, α is the aggregation number, $$(Log\alpha = 3.39066 T_b/T_c - 0.15848 - Log\ M)$$

d and

γT is the solubility parameter which is obtained from the formula:

$$\gamma T = \left[ \frac{(\Delta H_{25} - RT)d}{M} \right]^{1/2}$$

where $\Delta H_{25}$ is the heat of vaporization at 25° C., R is the gas constant (1.987 cal/mole/deg), T is the absolute temperature in ° K., $T_b$ is the boiling point in ° L. $T_c$ is the critical temperature in ° K., d is the density in g/ml, and M is the molecular weight.

For the compositions herein, hydrogen bonding parameters are preferably less than about 7.7, more preferably from about 2 to about 7, and even more preferably from about 3 to about 6. Solvents with lower numbers become increasingly difficult to solubilize in the compositions and have a greater tendency to cause a haze on glass. Higher numbers require more solvent to provide good greasy/oily soil cleaning. Cleaning solvents are typically used at a level of from about 1% to about 30%, preferably from about 2% to about 15%, more preferably from about 2% to about 8%. Dilute compositions for use full strength typically have solvents at a level of from about 1% to about 5%, preferably from about 2% to about 3.5%. Concentrated compositions contain from about 10% to about 30%, preferably from about 10% to about 20% of solvent.

Many of such solvents comprise hydrocarbon or halogenated hydrocarbon moieties of the alkyl or cyclo alkyl type, and have a boiling point well above room temperature, i.e., above about 20° C.

Preferred volatile solvents have boiling points of less than about 205° C. and/or vapor pressure at 25° C. of at least about 0.1 mm Hg.

The formulator of compositions of the present type will be guided in the selection of solvent partly by the need to provide good grease-cutting properties, and partly by aesthetic considerations and avoidance of filming/streaking.

Generically, the preferred glycol ethers useful herein have the formula $R^6O—(R^7O—)_mH$ wherein each $R^6$ is an alkyl group which contains from about 1 to about 8 carbon atoms, each $R^7$ is either ethylene or propylene, and m is a number from 1 to about 3. The most preferred glycol ethers are selected from the group consisting of monopropyleneglycolmonopropyl ether, dipropyleneglycolmonobutyl ether, monopropyleneglycolmonobutyl ether, diethyleneglycolmonohexylether, monoethyleneglycolmonohexyl ether, monoethyleneglycolmonobutyl ether, and mixtures thereof.

Any butoxy-propanol solvent should have no more than about 20%, preferably no more than about 10%, more preferably no more than about 7%, of the secondary isomer in which the butoxy group is attached to the secondary atom of the propanol for improved odor.

Optional Monoethanolaime and/or Beta-Aminoalkanol

Monoethanolamine and/or $C_{3-6}$ beta-aminoalkanol compounds serve primarily as solvents when the pH is above about 10.0, and especially above about 10.7. They also provide alkaline buffering capacity during use. However, the most unique contribution they make is to improve the filming/streaking properties of hard surface cleaning compositions containing the optional zwitterionic detergent cosurfactant, whereas they do not provide any substantial improvement in filming/streaking when used with the optional conventional anionic or ethoxylated nonionic detergent cosurfactants. When perfumes that have a high percentage of terpenes are incorporated, the benefit is usually greater for the beta-alkanolamines, and they are often preferred, whereas the monoethanolamine is usually preferred.

Monoethanolamine and/or $C_{3-6}$ beta-alkanolamine are used at a level of from about 0.05% to about 10%, preferably from about 0.2% to about 5%. For "dilute" compositions they are typically present at a level of from about 0.05% to about 2%, preferably from about 0.1% to about 1.0%, more preferably from about 0.2% to about 0.7%, and even more preferably from about 0.3% to about 0.6%. For concentrated compositions they are typically present at a level of from about 0.5% to about 10%, preferably from about 1% to about 5%.

Preferred beta-aminoalkanols have a primary hydroxy group. Suitable beta-aminoalkanols have the formula:

$$(R)_2—C(NH_2)—C(R)_2—OH$$

wherein each R is selected from the group consisting of hydrogen and alkyl groups containing from one to four carbon atoms and the total of carbon atoms in the compound is from three to six, preferably four. The amine group is preferably not attached to a primary carbon atom. More preferably the amine group is attached to a tertiary carbon atom to minimize the reactivity of the amine group. Specific preferred beta-aminoalkanols are 2-amino,1-butanol; 2-amino,2-methylpropanol; and mixtures thereof. The most preferred beta-aminoalkanol is 2-amino,2-methylpropanol since it has the lowest molecular weight of any beta-aminoalkanol which has the amine group attached to a tertiary carbon atom. The beta-aminoalkanols preferably have boiling points below about 175° C. Preferably, the boiling point is within about 5° C. of 165° C.

Such beta-aminoalkanols are excellent materials for hard surface cleaning in general and, in the present application, have certain desirable characteristics.

The beta-aminoalkanols are surprisingly better than, e.g., monoethanolamine for hard surface detergent compositions that contain perfume ingredients like terpenes and similar materials. However, normally the monoethanolamine is preferred for its effect in improving the filming/streaking performance of compositions containing zwitterionic detergent surfactant. The improvement in filming/streaking of hard surfaces that is achieved by combining the monoethanolamine and/or betaaminoalkanol was totally unexpected.

Good filming/streaking, i.e., minimal, or no, filming/streaking, is especially important for cleaning of, e.g., window glass or mirrors where vision is affected and for dishes and ceramic surfaces where spots are aesthetically undesirable. Beta-aminoalkanols can provide superior cleaning of hard-to-remove greasy soils and superior product stability, especially under high temperature conditions, when used in hard surface cleaning compositions, especially those containing more of the optional zwitterionic detergent surfactants.

Beta-aminoalkanols, and especially the preferred 2-amino-2-methylpropanol, are surprisingly volatile from cleaned surfaces considering their relatively high molecular weights.

The Optional Alkalinity Source

The compositions can contain, in addition to the alkanolamines discussed herein, an additional alkaline buffer to help give a pH in the product, at least initially, in use of from about 9.5 to about 13, preferably from about 9.7 to about 12, more preferably from about 9.7 to about 11.5. pH is usually measured on the product. Thus, the buffers that are present comprise monoethanolamine and/or beta-aminoalkanol and/or, optionally, but preferably, other alkaline material selected from the group consisting of: ammonia; other $C_{2-4}$ alkanolamines; alkali metal hydroxides; silicates; borates; carbonates; and/or bicarbonates; and mixtures thereof. Ammonia is a preferred alkaline material, especially when the alkanolamines are not present. The preferred optional alkalinity materials are alkali metal hydroxides. The level of such alkalinity source is from 0% to about 5% preferably from 0% to about 0.5%.

The Aqueous Solvent System

The balance of the formula is typically water and non-aqueous polar solvents with only minimal cleaning action like methanol, ethanol, isopropanol, ethylene glycol, propylene glycol, and mixtures thereof, preferably isopropanol. The level of nonaqueous polar solvent is greater when more concentrated formulas are prepared. Typically, the level of non-aqueous polar solvent is from about 0.5% to about 40%, preferably from about 1% to about 10%, more preferably from about 2% to about 8% (especially for "dilute" compositions) and the level of water is from about 50% to about 99%, preferably from about 75% to about 95%.

Other Optional Ingredients

The compositions herein can also contain other various adjuncts which are known to the art for detergent compositions. Preferably they are not used at levels that cause unacceptable filming/streaking. Non-limiting examples of such adjuncts are:

Enzymes such as proteases; Hydrotropes such as sodium toluene sulfonate, sodium cumene sulfonate and potassium xylene sulfonate; and Aesthetic-enhancing ingredients such as colorants and perfumes, providing they do not adversely impact on filming/streaking in the cleaning of glass. The perfumes are preferably those that are more water-soluble and/or volatile to minimize spotting and filming. Antibacterial agents can be present, but preferably only at low levels to avoid filming/streaking problems. More hydrophobic antibacterial/germicidal agents, like orthobenzyl-para-chlorophenol, are avoided. If present, such materials should be kept at levels below about 0.1%.

Detergent Builder

An optional ingredient for harder general cleaning purposes, is from 0% to about 30%, preferably from about 1% to about 15%, more preferably from about 1% to about 12%, of detergent builder. For use on glass and/or other shiny surfaces, a level of builder of from about 0.02% to about 0.5%, preferably from about 0.1% to about 0.2%, can be useful. While any of the builders or inorganic salts can be used herein, some examples of builders for use herein are sodium nitrilotriacetate, potassium pyrophosphate, potassium tripolyphosphate, sodium or potassium ethane-1-hydroxy-1,1-diphosphonate, and the nonphosphorous chelating agents described in U.S. Pat. No. 5,051,212, of Culshaw and Vos, issued Sep. 24, 1991, said patent being incorporated herein by reference. Useful examples include, e.g., carboxymethyltartronic acid, oxydimalonic acid, tartrate monosuccinic acid, oxydisuccinic acid, tartrate disuccinic acid, and mixtures thereof.

Other suitable builders are disclosed in U.S. Pat. No. 4,769,172, Siklosi, issued Sep. 6, 1988, and incorporated herein by reference.

The levels of builder present in the wash solution used for glass should be less than about 0.5%, preferably less than about 0.2%. Therefore, dilution is highly preferred for cleaning glass, while full strength use is preferred for general purpose cleaning.

Other effective detergent builders such as sodium citrate, sodium ethylenediaminetetraacetate, etc., can also be used, preferably at even lower levels, e.g., from about 0.1% to about 1%, preferably from about 0.1% to about 0.5%.

Inclusion of a detergent builder improves cleaning, but harms spotting and filming and has to be considered as a compromise in favor of cleaning. Inclusion of a detergent builder is optional and low levels are usually more preferred than high levels.

Perfumes

Most hard surface cleaner products contain some perfume to provide an olfactory aesthetic benefit and to cover any "chemical" odor that the product may have. The main function of a small fraction of the highly volatile, low boiling (having low boiling points), perfume components in these perfumes is to improve the fragrance odor of the product itself, rather than impacting on the subsequent odor of the surface being cleaned. However, some of the less volatile, high boiling perfume ingredients can provide a fresh and clean impression to the surfaces, and it is sometimes desirable that these ingredients be deposited and present on the dry surface. Perfume ingredients are readily solubilized in the compositions by the optional zwitterionic detergent surfactant. Other similar detergent surfactants will not solubilize as much perfume, especially substantive perfume, or maintain uniformity to the same low temperature.

The perfume ingredients and compositions of this invention are the conventional ones known in the art. Selection of any perfume component, or amount of perfume, is based solely on aesthetic considerations. Suitable perfume compounds and compositions can be found in the art including U.S. Pat. Nos.: 4,145,184, Brain and Cummins, issued Mar. 20, 1979; 4,209,417, Whyte, issued Jun. 24, 1980; 4,515,705, Moeddel, issued May 7, 1985; and 4,152,272, Young, issued May 1, 1979, all of said patents being incorporated herein by reference. Normally, the art-recognized perfume compositions are not very substantive to minimize their effect on hard surfaces.

Perfumes can be classified according to their volatility, as mentioned hereinbefore. The highly volatile, low boiling, perfume ingredients typically have boiling points of about 250° C. or lower. Many of the more moderately volatile perfume ingredients are also lost substantially in the cleaning process. The moderately volatile perfume ingredients are those having boiling points of from about 250° C. to about 300° C. The less volatile, high boiling, perfume ingredients referred to hereinbefore are those having boiling points of about 300° C. or higher. A significant portion of even these high boiling perfume ingredients, considered to be substantive, is lost during the cleaning process, and it may be desirable to have means to retain more of these ingredients on the dry surfaces. Many of the perfume ingredients, along with their odor character, and their physical and chemical properties, such as boiling point and molecular weight, are given in "Perfume and Flavor Chemicals (Aroma Chemicals)," Steffen Arctander, published by the author, 1969, incorporated herein by reference.

Examples of the highly volatile, low boiling, perfume ingredients are: anethole, benzaldehyde, benzyl acetate, benzyl alcohol, benzyl formate, isobornyl acetate, camphene, cis-citral (neral), citronellal, citronellol, citronellyl acetate, paracymene, decanal, dihydrolinalool, dihydromyrcenol, dimethyl phenyl carbinol, eucalyptol, geranial, geraniol, geranyl acetate, geranyl nitrile, cis-3-hexenyl acetate, hydroxycitronellal, d-limonene, linalool, linalool oxide, linalyl acetate, linalyl propionate, methyl anthranilate, alpha-methyl ionone, methyl nonyl acetaldehyde, methyl phenyl carbinyl acetate, laevo-menthyl acetate, menthone, iso-menthone, myrcene, myrcenyl acetate, myrcenol, nerol, neryl acetate, nonyl acetate, phenyl ethyl alcohol, alpha-pinene, beta-pinene, gamma-terpinene, alpha-terpineol, beta-terpineol, terpinyl acetate, and vertenex (para-tertiary-butyl cyclohexyl acetate). Some natural oils also contain large percentages of highly volatile perfume ingredients. For example, lavandin contains as major components: linalool; linalyl acetate; geraniol; and citronellol. Lemon oil and orange terpenes both contain about 95% of d-limonene.

Examples of moderately volatile perfume ingredients are: amyl cinnamic aldehyde, iso-amyl salicylate, beta-caryophyllene, cedrene, cinnamic alcohol, coumarin, dimethyl benzyl carbinyl acetate, ethyl vanillin, eugenol, iso-eugenol, flor acetate, heliotropine, 3-cis-hexenyl salicylate, hexyl salicylate, lilial (para-tertiarybutyl-alpha-methyl hydrocinnamic aldehyde), gamma-methyl ionone, nerolidol, patchouli alcohol, phenyl hexanol, beta-selinene, trichloromethyl phenyl carbinyl acetate, triethyl citrate, vanillin, and veratraldehyde. Cedarwood terpenes are composed mainly of alpha-cedrene, beta-cedrene, and other $C_{15}H_{24}$ sesquiterpenes.

Examples of the less volatile, high boiling, perfume ingredients are: benzophenone, benzyl salicylate, ethylene brassylate, galaxolide (1,3,4,6,7,8-hexahydro-4,6,6,7,8,8-hexamethylcyclo-penta-gama-2-benzopyran), hexyl cinnamic aldehyde, lyral (4-(4-hydroxy-4-methyl pentyl)-3-cyclohexene-10-carboxaldehyde), methyl cedrylone, methyl dihydro jasmonate, methyl-beta-naphthyl ketone, musk indanone, musk ketone, musk tibetene, and phenylethyl phenyl acetate.

Selection of any particular perfume ingredient is primarily dictated by aesthetic considerations, but more water-soluble materials are preferred, as stated hereinbefore, since such materials are less likely to adversely affect the good filming/streaking properties of the compositions. If the terpene types of perfume ingredients are used, the beta-aminoalkanols are preferred for product stability.

These compositions have exceptionally good cleaning properties. They can also be formulated either to be diluted or to have good "shine" properties, i.e., when used to clean glossy surfaces, without rinsing.

The compositions can be formulated either to be diluted or to be used at full strength, where the product is sprayed onto the surface to be cleaned and then wiped off with a suitable material like cloth, a paper towel, etc. The level of amphocarboxylate detergent surfactant (a) is disclosed herein. The other ingredients are typically adjusted to complement the amphocarboxylate detergent surfactant. E.g., the ratio of amphocarboxylate detergent surfactant (a) to any zwitterionic cosurfactant (c) is typically from about 3:1 to about 1:3; the ratio of total surfactant (a)+(c) to hydrophobic cleaning solvent (b) being from about 1:10 to about 1:40; and the ratio of total surfactant (a)+(c) to the monoethanolamine and/or beta-aminoalkanol (d) being from about 1:1 to about 1:7. Concentrated formulas are typically from about 2 to about 4, preferably about 3 times more concentrated by volume. They can be packaged in a package that comprises a means for creating a spray, e.g., a pump, aerosol propellant and spray valve, etc.

The invention is illustrated by the following Examples.

EXAMPLE I

| Ingredient | Formula No.* (Wt. %) 1 | 2 | 3 | 4 |
|---|---|---|---|---|
| Propylene Glycol Monobutylether | 2.0 | 2.0 | 2.0 | 2.0 |
| Isopropanol | 5.0 | 5.0 | 5.0 | 5.0 |
| Caprylic Glycinate[1] | 0.16 | 0.00 | 0.00 | 0.00 |
| Caprylic Amphopropionate[2] | 0.00 | 0.16 | 0.00 | 0.00 |
| Coco Glycinate[3] | 0.00 | 0.00 | 0.16 | 0.00 |
| Coco Amphopropionate[4] | 0.00 | 0.00 | 0.00 | 0.16 |
| Monoethanolamine | 0.3 | 0.3 | 0.3 | 0.3 |
| Deionized Water | q.s. | q.s. | q.s. | q.s. |

*pH adjusted to about 11.0
[1]Rewoteric AM-V
[2]Monateric 1000
[3]Miranol CM-NP
[4]Miranol CM-SF Filming/Streaking Stress Test Procedure:

A paper towel is folded into eighths. Two milliliters of test product are applied to the upper half of the folded paper towel. The wetted towel is applied in one motion with even pressure from top to bottom of a previously cleaned window or mirror. The window or mirror with the applied product(s) is allowed to dry for ten minutes before grading under stress lighting conditions by expert judges. After the initial grading, the residues are buffed with a dry paper towel using a single downward wipe and then regraded.

Grading:.

Expert judges are employed to evaluate the specific areas of product application for amount of filming/streaking. A numerical value describing the amount of filming/streaking is assigned to each product. For the test results reported here a 0–6 scale was used.

0=No Filming/Streaking

6=Poor Filming/Streaking

Room temperature and humidity have been shown to influence filming/streaking. Therefore these variables are always recorded.

Filming/Streaking Stress Test on Glass Windows (Four Replications at 73° F. and 53% Relative Humidity)

| Formula No. | Mean Rating (Initial) | Mean Rating (After Buffing) |
|---|---|---|
| 1 | 1.9 | 1.4 |
| 2 | 0.8 | 2.1 |
| 3 | 1.3 | 5.2 |
| 4 | 1.5 | 4.8 |

The least significant difference between mean ratings is 0.8 at 95% confidence level.

Based upon the above the short chain true glycinate is clearly superior to the long chain glycinate and is about equivalent to the short chain propionate. This is especially evident in the grades after buffing, where the "short" chain provides a big improvement over the same detergent surfactant type with conventional detergent length ($-C_{12}$) hydrophobic group.

EXAMPLE II

| Ingredient | Formula No. (Wt. %) 1 | 2 | 3 | 4 |
|---|---|---|---|---|
| Caprylic Glycinate | 0.025 | 0.15 | 0.05 | 0.02 |
| Cocoamidopropyl-dimethyl-2-hydroxy-3-sulfopropylbetaine | 0.025 | 0.15 | 0.05 | 0.05 |
| Monoethanolamine | 0.25 | 0.5 | 0.25 | 0.25 |
| Propylene Glycol Monobutylether | 1.5 | 3.0 | 2.0 | 2.0 |
| Isopropanol | 3.0 | 6.0 | 6.0 | 3.0 |
| Deionized Water and Minors (e.g., Perfume) | q.s. | q.s. | q.s. | q.s. |

All pH's adjusted to about 10.9

Filming/Streaking Stress Test on Glass Windows (Four Replications at 73° F. and 64% Relative Humidity)

| Formula No. | Mean Rating (Initial) | Mean Rating (After Buffing) |
|---|---|---|
| 1 | 0.5 | 0.0 |
| 2 | 2.0 | 1.5 |
| 3 | 1.5 | 0.0 |
| 4 | 1.5 | 0.5 |

EXAMPLE III

| Ingredient | Formula No.* Wt. % 1 | 2 | 3 | 4 | 5 |
|---|---|---|---|---|---|
| Caprylic Glycinate | 0.15 | 0.15 | 0.15 | 0.02 | 0.15 |
| Cocoamidopropylbetaine | — | — | — | — | 0.05 |
| Monoethanolamine | 0.3 | 0.0 | 0.0 | 0.0 | 0.3 |
| Propylene Glycol Monobutylether | 2.0 | 2.0 | 2.0 | 2.0 | 2.0 |
| Isopropanol | 5.0 | 5.0 | 5.0 | 5.0 | 5.0 |
| NaOH | 0.0 | 0.01 | 0.0 | 0.0 | 0.0 |
| 2-Aminopropanol | 0.0 | 0.0 | 0.0 | 0.3 | 0.0 |
| Deionized Water and Minors (e.g., Perfume) | q.s. | q.s. | q.s. | q.s. | q.s. |
| pH | 10.87 | 10.84 | 9.8 | 10.85 | 10.89 |

Filming/Streaking Stress Test on Glass Windows (Four Replications at 74° F. and 55% Relative Humidity)

-continued

EXAMPLE III

| Formula No. | Mean Rating (Initial) | Mean Rating (After Buffing) |
|---|---|---|
| 1 | 0.8 | 0.3 |
| 2 | 1.2 | 1.0 |
| 3 | 2.2 | 1.4 |
| 4 | 1.3 | 0.5 |
| 5 | 1.3 | 1.4 |

Monoethanoethanolamine and/or beta-aminoalkanols appear to help improve filming/streaking grades even more.

EXAMPLE IV

| Ingredient | Formula No. (Wt. %) 1 | 2 | 3 | 4 |
|---|---|---|---|---|
| Caprylic Glycinate | 0.05 | — | — | — |
| $C_6$ Glycinate | — | — | 0.016 | 0.1 |
| Sodium $C_{12}$ Alkyl Sulfate | — | 0.02 | — | — |
| Cocoamidopropyl-dimethyl-2-hydroxy-3-sulfo-propylbetaine | 0.05 | 0.16 | — | 0.1 |
| Monoethanolamine | 0.5 | 0.5 | 0.3 | 0.3 |
| Propylene Glycol Monobutylether | 3.0 | 3.0 | 2.0 | 2.0 |
| Isopropanol | 6.0 | 6.0 | 5.0 | 5.0 |
| Deionized Water and Minors (e.g., Perfume) | q.s. | q.s. | q.s. | q.s. |
| All pH's adjusted to about 10.9 | | | | |

Filming/Streaking Stress Test on Glass Windows (Four Replications at 73° F. and 64% Relative Humidity)

| Formula No. | Mean Rating (Initial) | Mean Rating (After Buffing) |
|---|---|---|
| 1 | 2.0 | 1.5 |
| 2 | 3.0 | 4.8 |
| 3 | 3.6 | 2.8 |
| 4 | 1.9 | 1.8 |

EXAMPLE V

| Ingredient | Formula No. (Wt. %) 1 | 2 | 3 |
|---|---|---|---|
| Isopropanol | 2.0 | 2.0 | 2.0 |
| Butoxypropanol | 3.0 | 3.0 | 3.0 |
| Monoethanolamine | 0.50 | 0.50 | 0.50 |
| Cocoamidopropylhydroxy sultaine | 0.075 | 0.075 | 0.075 |
| $C_{8,10}$-carboxymethoxy-ethylglycinate | 0.075 | 0.075 | — |
| $C_8$, 10-hydroxy-ethylglycinate | — | — | 0.075 |
| Sodium Acetate | 0.05 | 0.05 | 0.05 |
| Perfume | 0.11 | 0.13 | 0.11 |
| Soft Water to Balance | | ←BALANCE→ | |

What is claimed is:

1. An aqueous liquid hard surface detergent composition having superior filming/streaking characteristics comprising:

(a) from about 0.001% to about 1% detergent surfactant having the generic formula:

$$RN(R^1)CH_2)_nN(R^2)(CH_2)_pC(O)OM$$

wherein R is a $C_{6-10}$ hydrophobic fatty acyl moiety which in combination with the nitrogen atom forms an amido group, $R^1$ is hydrogen or a $C_{1-2}$ alkyl group, each $R^2$ is a $C_{1-3}$ alkyl or substituted $C_{1-3}$ alkyl, each n is an integer from 1 to 3, each p is an integer from 1 to 2, and M is a water-soluble cation selected from alkali metal, ammonium, alkanolammonium, and mixtures thereof, (b) from about 1% to about 8% volatile, hydrophobic cleaning solvent having a hydrogen bonding parameter of less than about 7.7;

(c) from about 0.2% to about 5% monoethanolamine and/or beta-aminoalkanol containing from three to about six carbon atoms; and (d) the balance being an aqueous solvent system comprising water and optionally a non-aqueous polar solvent with only minimal cleaning action selected from the group consisting of methanol, ethanol, isopropanol, ethylene glycol, propylene glycol, and mixtures thereof.

2. The composition of claim 1 wherein (c) is monoethanolamine.

3. The composition of claim 1 additionally comprising as detergent cosurfactant from about 0.02% to about 0.2% of hydrocarbylamidoalkylenesulfobetaine which has the formula:

$$R_3—C(O)—N(R^4)—(CR^5{}_2)_n—N(R^6)_2{}^{(+)}—(CR^5{}_2)_p—SO_3{}^{(-)}$$

wherein each $R^3$ is an alkyl, or alkylene, group containing from about 10 to about 18 carbon atoms, each ($R^4$) and ($R^6$) is selected from the group consisting of hydrogen, methyl, ethyl, propyl, hydroxy substituted ethyl or propyl and mixtures thereof, each ($R^5$) is selected from the group consisting of hydrogen and hydroxy groups, and each n and p is a number from 1 to about 4; with no more than about one hydroxy group in any ($CR^5{}_2$) moiety.

4. The composition of claim 3 wherein the ratio of said detergent surfactant (a) to said detergent cosurfactant is from about 3:1 to about 1:3.

5. The composition of claim 3 wherein the ratio of said detergent surfactant (a) to said detergent cosurfactant is from about 2:1 to about 1:2.

6. The composition of claim 3 wherein the ratio of said detergent surfactant (a) to said detergent cosurfactant is about 1:1.

7. The composition of claim 1 additionally comprising as detergent of cosurfactant from about 0.001% to about 2% hydrocarbyl-amidoalkylenebetaine which has the formula:

$$R^3—C(O)—N(R^4)—(CR^5{}_2)_n—N(R^6)_2{}^{(+)}—(CR^5{}_2)_p—COO^{(-)}$$

wherein each $R^3$ is an alkyl, or alkylene, group containing from about 10 to about 18 carbon atoms, each ($R^4$) and ($R^6$) is selected from the group consisting of hydrogen, methyl, ethyl, propyl, hydroxy substituted ethyl or propyl and mixtures thereof, each ($R^5$) is selected from the group consisting of hydrogen and hydroxy groups, and each n and p is a number from 1 to about 4; with no more than about one hydroxy group in any ($CR^5{}_2$) moiety.

8. The composition of claim 1 wherein the cleaning solvent (b) is a glycol ether having the formula $R^6O—(R^7O—)_mH$ wherein each $R^6$ is an alkyl group which contains from about 1 to about 8 carbon atoms, each $R^7$ is either ethylene or propylene, and m is a number from 1 to about 3.

9. The composition of claim 1 wherein the cleaning solvent (b) is selected from the group consisting of monopropyleneglycolmonopropyl ether, dipropyleneglycolmonobutyl ether, monopropyleneglycolmonobutyl ether, diethyleneglycolmonohexyl ether, monoethyleneglycolmonohexyl ether, monoethyleneglycolmonobutyl ether, and mixtures thereof.

10. The composition of claim 1 wherein the cleaning solvent (b) is monopropyleneglycolmonobutyl ether.

11. The composition of claim 1 wherein n is 2 and p is 1.

12. The composition of claim 11 wherein (c) is monoethanolamine.

13. The Composition of claim 11 additionally comprising as detergent cosurfactant from about 0.02% to about 0.2% of hydrocarbylamidoalkylenesulfobetaine which has the formula:

$$R^3—C(O)—N(R^4)—(CR^5{}_2)_n—N(R^6)_2{}^{(+)}—(CR^5{}_2)_p—SO_3{}^{(-)}$$

wherein each $R^3$ is an alkyl, or alkylene, group containing from about 10 to about, 18 carbon atoms, each ($R^4$) and ($R^6$) is selected from the group consisting of hydrogen, methyl, ethyl, propyl, hydroxy substituted ethyl or propyl and mixtures thereof, each ($R^5$) is selected from the group consisting of hydrogen and hydroxy groups, and each n and p is a number from 1 to about 4; with no more than about one hydroxy group in any ($CR^5{}_2$) moiety.

14. The composition of claim 11 additionally comprising as detergent cosurfactant from about 0.001% to about 2% hydrocarbyl-amidoalkylenebetaine which has the formula:

$$R^3—C(O)—N(R^4)—(CR^5{}_2)_n—N(R^6)_2{}^{(+)}—(CR^5{}_2)_p—COO^{(-)}$$

wherein each $R^3$ is an alkyl, or alkylene, group containing from about 10 to about 18 carbon atoms, each ($R^4$) and ($R^6$) is selected from the group consisting of hydrogen, methyl, ethyl, propyl, hydroxy substituted ethyl or propyl and mixtures thereof, each ($R^5$) is selected from the group consisting of .hydrogen and hydroxy groups, and each n and p is a number from 1 to about 4; with no more than about one hydroxy group in any ($CR^5{}_2$) moiety.

15. The composition of claim 1 having a pH of from about 9.5 to about 13.

16. The composition of claim 15 wherein said pH is from about 9.7 to about 12.

17. An aqueous liquid hard surface detergent composition having superior filming/streaking characteristics comprising:

(a) from about 0.03% to about 0.1% detergent surfactant having the generic formula:

$$RN(R^1(CH_2)_nN(R^2)(CH_2)_pC(O)OM$$

wherein R is a $C_{6-10}$ hydrophobic fatty acyl moiety which in combination with the nitrogen atom forms an amido group, $R^1$ is hydrogen or a $C_{1-2}$ alkyl group, each $R^2$ is a $C_{1-3}$ alkyl, carboxymethoxy ethyl, or hydroxy ethyl, each n is an integer from 1 to 3, each p is an integer from 1 to 2, and M is a water-soluble cation selected from alkali metal, ammonium, alkanolammonium, and mixtures thereof, (b) from about 2% to about 3.5% mono-propyleneglycolmonobutyl ether;

(c) as detergent cosurfactant from about 0.03% to about 0.10% hydrocarbyl amido-alkylenesulfobetaine which has the formula:

$$R^3—C(O)—N(R^4)—(CR^5{}_2)_n—N(R^6)_2{}^{(+)}—(CR^5{}_2)_p—SO_3{}^{(-)}$$

wherein each $R^3$ is an alkyl, or alkylene, group containing from about 10 to 18 carbon atoms, each ($R^4$) and ($R^6$) is selected from the group consisting of hydrogen, methyl, ethyl, propyl, hydroxy substituted ethyl or propyl and mixtures thereof, each ($R^5$) is selected from the group consisting of hydrogen and hydroxy groups, and each n and p is a number from 1 to about 4; with no more than about one hydroxy group in any ($CR^5{}_2$) moiety;

(d) from about 0.3% to about 0.6% monoethanolamine and/or betaaminoalkanol containing from three to about six carbon atoms; and (e) the balance being an aqueous solvent system comprising water and optionally a non-aqueous polar solvent with only minimal cleaning action selected from the group consisting of methanol, ethanol, isopropanol, ethylene glycol, propylene glycol, and mixtures thereof.

18. The composition of claim 17, wherein (e) comprises from about 3% to about 8% isopropanol.

19. The composition of claim 1 wherein, in (a), each $R^2$ is selected from the group consisting of: $C_{1-3}$ alkyl group substituted with a carboxymethoxy group and $C_{1-3}$ alkyl group substituted with a hydroxy group.

20. The composition of claim 1 wherein, in (a), $R^2$ is a carboxymethoxy ethyl group,

21. The composition of claim 1 wherein, in (a), $R^2$ is a hydroxy ethyl group.

* * * * *